United States Patent [19]

Riss et al.

[11] Patent Number: 4,714,034

[45] Date of Patent: Dec. 22, 1987

[54] BUTTON FEEDING DEVICE FOR BUTTON ATTACHING MACHINES

[75] Inventors: Gerhard Riss; Richard Fuerhoff, both of Bielefeld, Fed. Rep. of Germany

[73] Assignee: Durkoppwerke GmbH, Fed. Rep. of Germany

[21] Appl. No.: 869,110

[22] Filed: May 30, 1986

[30] Foreign Application Priority Data

Jun. 1, 1985 [DE] Fed. Rep. of Germany ..... 3519659

[51] Int. Cl.[4] ..... D05B 3/22

[52] U.S. Cl. ..... 112/113; 227/119

[58] Field of Search ..... 227/119, 120; 112/113

[56] References Cited

U.S. PATENT DOCUMENTS

| | | | |
|---|---|---|---|
| 2,921,544 | 1/1960 | Willis et al. | 112/113 |
| 3,363,805 | 1/1968 | Prezes | 112/113 |
| 3,633,524 | 1/1972 | Hoffsommer et al. | 112/113 |
| 3,889,612 | 6/1975 | Hughes et al. | 112/113 |
| 3,960,094 | 6/1976 | Hsiao | 112/113 X |
| 4,007,537 | 2/1977 | Silverbush et al. | 227/119 X |
| 4,094,259 | 6/1978 | Fletcher et al. | 227/119 X |
| 4,569,470 | 2/1986 | Tanaka | 227/119 X |
| 4,651,657 | 3/1987 | Kennedy | 112/113 |

FOREIGN PATENT DOCUMENTS

| | | |
|---|---|---|
| 2559832 | 5/1976 | Fed. Rep. of Germany . |
| 34682 | 8/1968 | German Democratic Rep. . |

*Primary Examiner*—Paul A. Bell

*Attorney, Agent, or Firm*—Ostrolenk, Faber, Gerb & Soffen

[57] ABSTRACT

A button feeding device includes a button alignment shaft having a longitudinal axis which is displaceable with respect to the longitudinal axis of the main drive shaft. The button alignment shaft and the main drive shaft are advantageously linked for rotation by a coil spring. The device has a pin holder which aligns the button and transfers it into a button clamp, a carriage being provided to move the pin holder over a substantially linear quadrangular path.

13 Claims, 4 Drawing Figures

BUTTON FEEDING DEVICE FOR BUTTON ATTACHING MACHINES

BACKGROUND OF THE INVENTION

1. Field of the Invention

The present invention relates to a button feeding device, and more particularly to a button feeding device in the form of an independent attachment for a button attaching machine for providing proper alignment of buttons transferred from a magazine.

2. Description of Related Art

A button feeding device is disclosed in Federal Republic of Germany Pat. No. 10 55 335, equivalent to U.S. Pat. No. 2,921,544 in which a button is taken from a conventional magazine, is slid into the filling jaws of an alignment station and is turned momentarily by a lowerable driver disk, which carries out turning movements of about 180°, until the holes in the button are received by the pins of a pin holder. The pin holder is fastened on the end of a connecting rod which is part of a flat, four-pivot crank mechanism. In this way, the pin holder passes over a path of movement having the shape of approximately a quarter circle which terminates in an approximately linear section only at the end of said movement.

This known button feeding device has the following disadvantages:

1. Since the pin holder is movable only in the horizontal plane, the button clamp must be lifted briefly after the pin holder has transferred the button into the button clamp. Without this lifting movement, which delays the course of the operation, it is not possible to withdraw the button from the pin holder.

2. The driver disk, which carries out rotary oscillations, cannot be shifted towards the center of rotation of its drive.

3. The pivot points of the crank mechanism which moves the pin holder are subject to wear, particularly upon continuous use, and tend to become noisy.

In another button feeding device, disclosed in German Democratic Republic Pat. No. 34 682, a button, after being removed from a magazine, drops into an alignment station formed by a momentarily lowerable pot and is turned by a plate which carries out a rotary movement until the pins of the pin holder which is arranged above the button engage in the holes in the button. The pin holder is guided on a parabolic path by a four-pivot slider-crank mechanism. This device has the same disadvantages with respect to susceptibility to wear and noise that were noted above. Furthermore, it is not possible with the device of German Democratic Republic Pat. No. 34 682 to displace the plate from the center of rotation of its drive.

SUMMARY OF THE INVENTION

Accordingly, a principal object of the invention is to avoid the above-mentioned disadvantages of the known prior art devices.

In accordance with a preferred embodiment of the invention, a button feeding device includes a button alignment shaft which is displaceable with respect to the center of rotation of its drive. The device has a pin holder which aligns the button and transfers it into the button clamp, the pin holder carrying out a linear quadrangular movement which takes place over a non-curved path.

With the button feeding device of the invention, it is possible to briefly lift the button slightly upward by the pins of the pin holder, turn the button by the button alignment shaft around its axis of symmetry only until the pins enter the holes in the button, and then transfer the button, by a carriage assembly which has only one rotary point and two slide points, on a non-curved path into the button clamp. No additional lifting of the button clamp is necessary upon the removal of the button from the pin holder, in view of the quadrangular movement of the pin holder.

According to one aspect of the invention, there is provided a button feeding device for aligning a button and placing it in sewing position. There are receiving means for receiving a button from a magazine and locating it in an alignment station. Driver disk means at the alignment station rotate the button to align it so that holes in the button are in a desired position. Button clamp means at a sewing station receive the button after alignment and place the button at a sewing position. Pin holder means hold the button in operative engagement with the driver disk means for being aligned thereby and for transferring the button to the button clamp means after alignment. Alignment shaft means, on which said driver disk means is mounted for rotation, have a first longitudinal axis. There are drive means having a second longitudinal axis for rotating the alignment shaft means. The alignment shaft means is displaceable such that the second longitudinal axis is displaceable with respect to the first longitudinal axis, while still being rotatable by the drive means.

According to a further aspect of the invention, the button feeding device comprises carriage means on which the pin holder means is mounted for being moved substantially horizontally between the alignment station and the sewing station. The pin holder means is further moved substantially vertically upward at the alignment station to bring the button into operative engagement with the driver disk means and it is moved substantially vertically downward at the sewing station for transferring the button to the button clamp means. The pin holder means is thereby moved by the carriage means in a substantially linear quadrangular path.

BRIEF DESCRIPTION OF THE DRAWINGS

Other objects, features and advantages of the invention will be seen from the following detailed description of a preferred embodiment thereof, with reference to the drawings, in which.

DESCRIPTION OF THE PREFERRED EMBODIMENT

Figure 1:
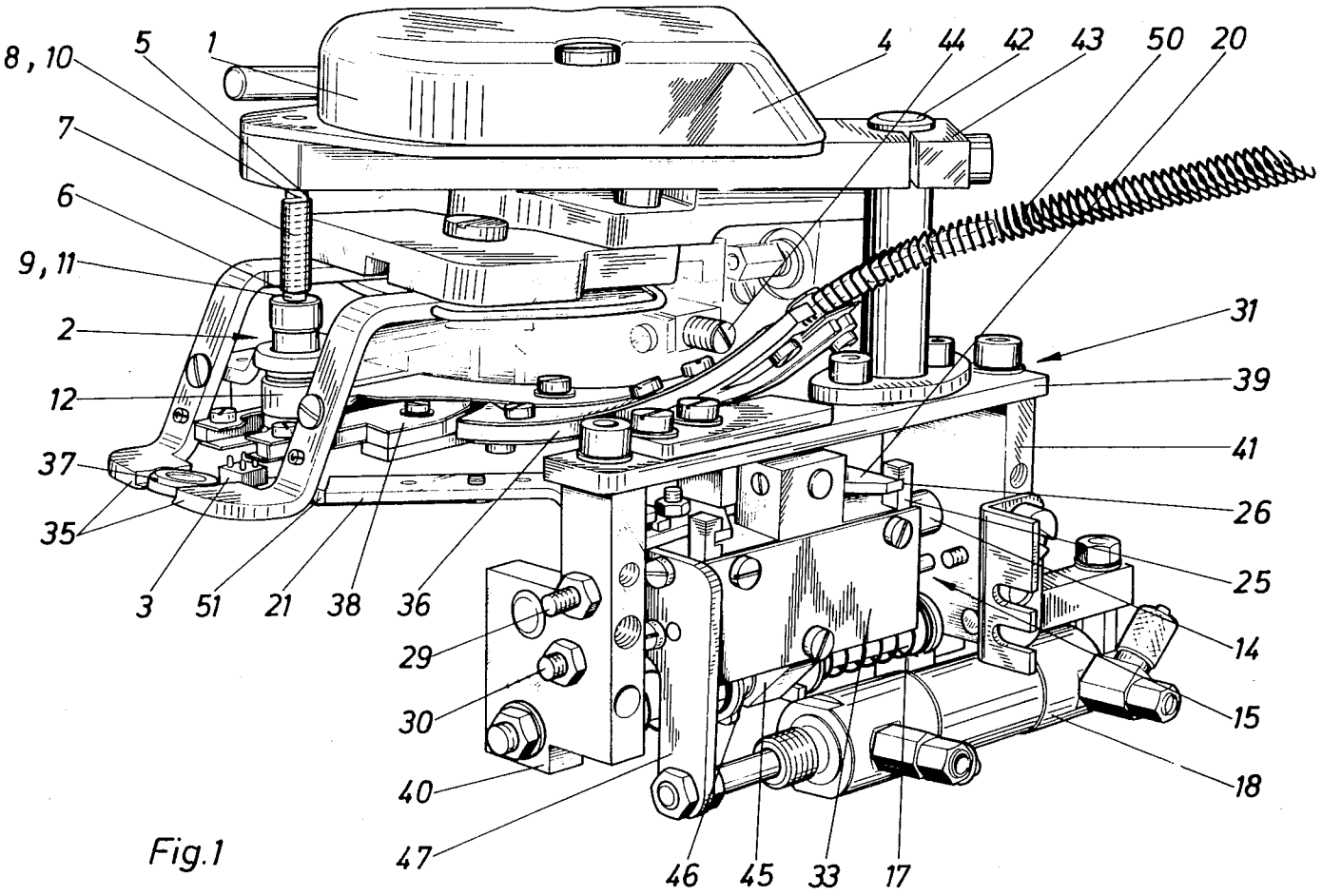
FIG. 1 is a perspective view of a complete button feeding device according to an embodiment of the invention, the button clamp mechanism being partially indicated.

FIG. 1 shows a button feed device, which in this embodiment is an attachment to be arranged alongside a known button sewing machine (not shown). A frame 31 comprising a plate 39 and two side parts 40, 41 serves as basic structure for the button feeding device and is to be firmly connected to the protruding cylindrical sewing-material support arm (now shown) of the button attaching machine.

On the top of the plate 39 there is provided, as shown in FIG. 1, a guide channel 36 which conducts buttons coming from a fixed magazine (not shown) to an alignment station just in front of the sewing point. The alignment station includes a vertically arranged button alignment shaft 2 and two guide jaws 38, mounted below the plate 39, which receive and guide a button 37 which has been brought into the alignment station, without holding it fast. The guide jaws 38 can be adjusted to center them on the center of rotation of the button alignment shaft 2 by adjustment screws 44. By suitable slight adjustments of the guide jaws 38, the alignment station can easily be set for different outside diameters of buttons. Further description of this adjustment of the guide jaws 38 is unnecessary since it is effected in a manner similar to the known adjustment of the button clamps 35.

Figure 4:
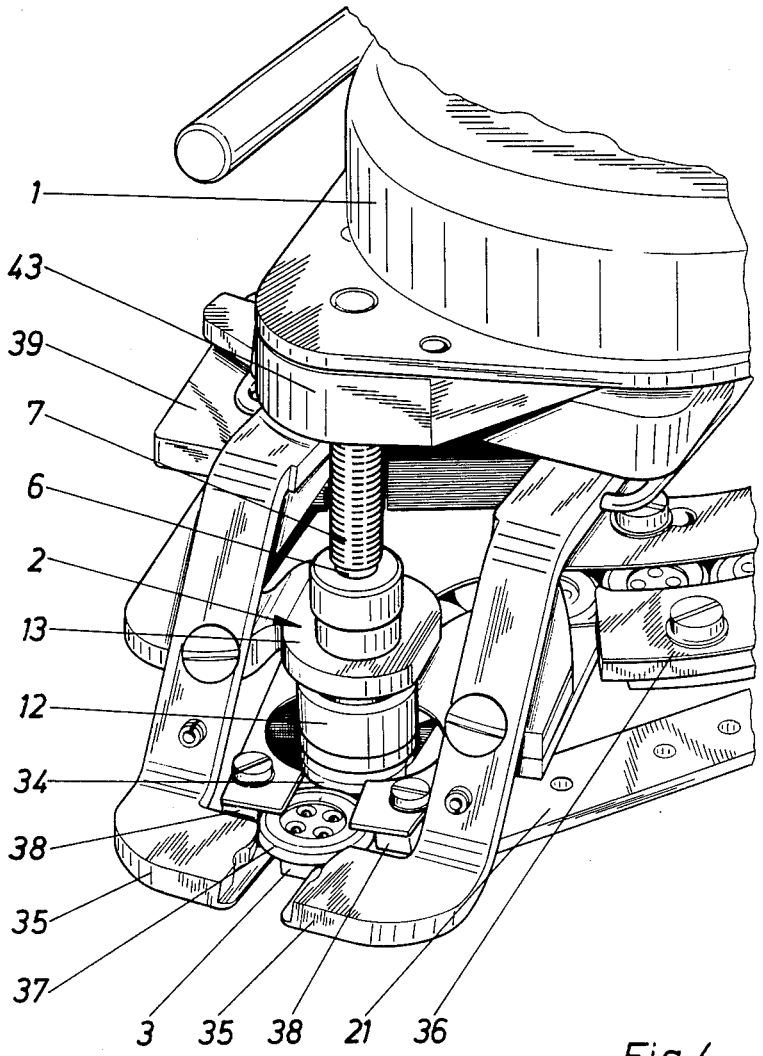
FIG. 4 is a perspective view of a forward portion of the button feeding device, including the button alignment shaft.

Above the plate 39 there is provided an angle member 13 in which the button alignment shaft 2 is rotatably mounted (see FIGS. 1 and 4). Furthermore, a column 42 is firmly connected to the plate 39 and receives an extension 43. On the extension 43 is mounted a drive 1 which consists of a separate small motor 4, operating independently of the sewing drive, with a reduction gearing behind it. At the output of the reduction gearing there is arranged a stub shaft 5 which is rotatably mounted in the extension 43 and has a slot 10 on its free end.

The button alignment shaft includes a bolt 12 which is mounted for rotation, but nonremovably, in the angle member 13. Mounted on an upper end of the bolt 12 is a pin 6, which has a slot 11 near the bolt 12 (see FIG. 4). A driver disk 34 consisting of resilient material is firmly connected to the bottom of the bolt 12, as shown in FIG. 4.

After the loosening of its fastening screws the angle member 13 can be displaced horizontally on the plate 39, whereby the longitudinal axis of the button alignment shaft 2 can be adjusted within well-defined limits with respect to the center of rotation of the stub shaft 5. In this way, functionally correct alignment of the button alignment shaft 2 with the center of the two guide jaws 38 is possible.

Rotary movement is transmitted from the drive 1 to the button alignment shaft 2 by a coil spring 7, which at its upper and lower ends has linearly bent arms 8 and 9, respectively, extending through its center axis. The arm 8 is received in form-locked manner by the slot 10 and the arm 9 is received in form-locked manner by the slot 11. Said coil spring 7 permits, on the one hand, the adjustment of the button alignment shaft 2 towards the center of rotation of the drive 1, i.e., towards the center of rotation of the stub shaft 5; while, on the other hand, by the removal of the coil spring 7, the rapid installation and removal of the button clamp 35 is assured.

The linear transfer of the aligned button 37 from the alignment station to its correct position for sewing in the button clamp 35, which can be noted in FIG. 4, is effected by a carriage 15 which is displaceable on a slide rod 14 mounted between the side parts 40, 41. To prevent the carriage 15 from rotating about the slide rod 14, the carriage 15 includes a block 45 which is mounted on a second slide rod 46. The slide rod 46 extends parallel to the slide rod 14 and is also mounted between the side parts 40, 41. For moving the carriage 15 there is provided a double-acting cylinder 18, actuatable by a pressure fluid, which acts on an extension 47 which is rigidly attached to the carriage 15, which cylinder can be acted on in a known manner by compressed air or a hydraulic fluid. The control of the action of the pressure fluid on the cylinder 18, for example by means of solenoid valves, is well known and will not be described in detail here.

Within the carriage 15 there is force-fitted a horizontally arranged pin 19 on which a rocker 20 is swingably mounted. The rocker has two arms 48, 49 of equal length, in each of which there is an adjustable stop 28 which limits the swinging motion of the rocker 20. On an extension 27 which extends above the front of the rocker 20 there is fastened a support angle member 21. After loosening its attachment screws the support angle member 21 can be set in different positions within a well-defined region. It is advisable to provide a leaf spring 51 below the support angle member 21, at its front end, to which spring a pin holder 3 is fastened, the pins of which thus press relatively gently against the bottom of the button 37 which is to be aligned.

Figure 3:
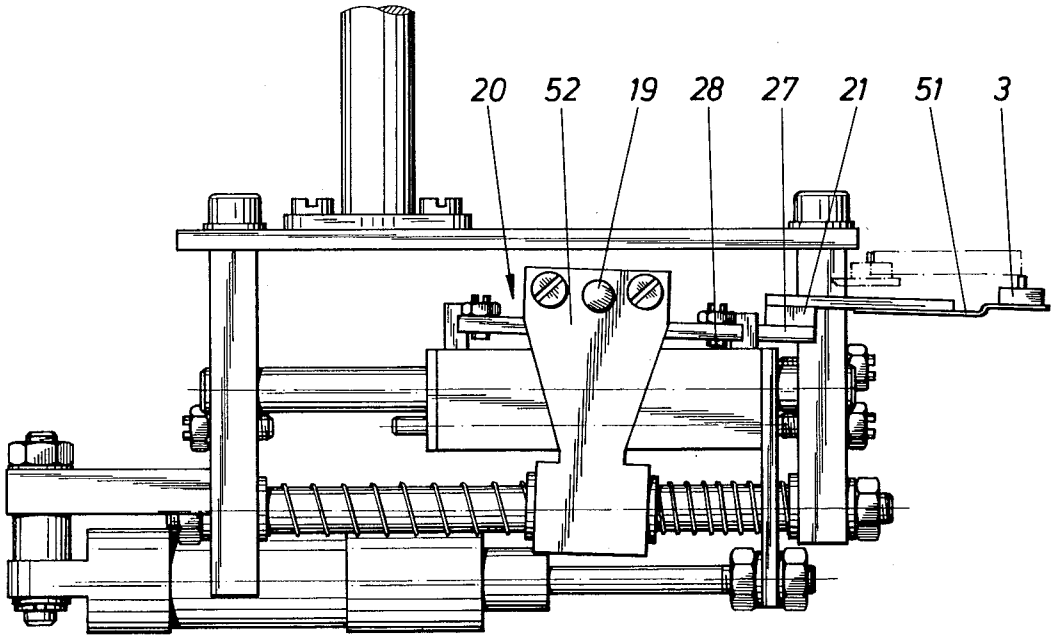
FIG. 3 is a right side view of the carriage, the drive for the button alignment shaft and the button clamp not being shown.

Rigidly connected to the rocker 20 is an angle member 52, visible in FIG. 3, having lower arms 53 which form a U-shape and thereby grip around the slide rod 46. Four washers 54 are provided on said slide rod. Compression springs 16, 17 are also placed on the slide rod 46 between the washers 54 and the side parts 40, 41.

A cover plate 33 is removably fastened to the carriage 15. Behind this cover plate is a continuous groove of rectangular cross-section extending parallel to the slide rod 14, said groove receiving two slides 22. Between these slides there is arranged a compression spring 23 which presses one slide 22 to the front and the other to the rear. Furthermore, the forward slide 22 (see FIG. 2) has a projecting cylindrical pin 24 and the rear slide has a projecting pin 24'. The two pins 24, 24' pass through the outer walls of the carriage 15.

Figure 2:
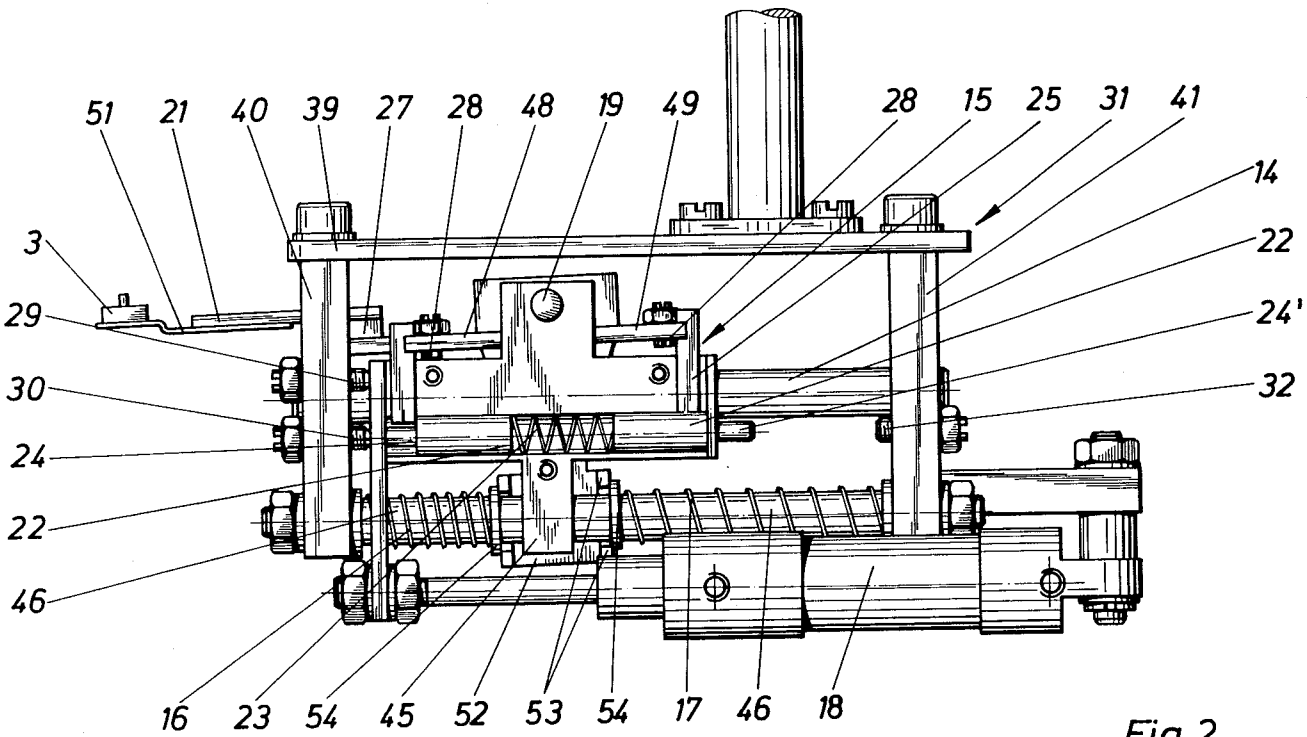
FIG. 2 is a left side view of the carriage, shown in its forward position with the cover plate removed, the drive for the button alignment shaft and the button clamp not being shown.

Furthermore, as shown in FIGS. 1 and 2, two push rods 25 which are movable vertically at right angles to the slides 22 are mounted in suitably shaped grooves in the carriage 15, the lower ends of each of the push rods 25 resting on one of the slides 22. Each of these push rods 25 has a slot 26 into which one of the end pieces of the arm 48 or 49 of the rocker 20 engages in form-locked fashion.

In the side part 40 there is provided an adjustable stop 29 which limits the forward position of the carriage 15. There is also arranged in the side part 40 another adjustable stop 30 against which the pin 24 strikes before reaching the forward position of the carriage 15. In the side part 41 an adjustable stop 32 is also provided against which the pin 24' strikes before reaching the rear position of the carriage 15. Each of the stops 28, 29, 30 and 32 includes an adjustment screw, the adjusted position of which is secured by a lock nut.

The manner of operation of the button feeding device will now be described. In the operation of the button attaching machine, buttons are continuously removed automatically in a known manner from a stationary magazine, and then pass by their own weight, through a known flexible guide hose 50 made of spring steel, into a guide channel 36. In order to assist in the passing of the buttons, a compressed air nozzle (not shown in the drawing) is arranged on a side of the guide channel 36. The jet of air which escapes from the nozzle causes the button 37 to pass freely through the guide channel 36, as a result of which the button 37 passes reliably into the guide jaws of the alignment station.

At the same time as the introduction of a button 37 into the alignment station, the carriage 15 passes, by corresponding actuation of the cylinder 18, into its rearward position, the compression spring 17 being increasingly compressed. Shortly before reaching the rearward position, the pin 24' comes against the stop 32, as a result of which the slide 22 pushes, against the action of the compression spring 23, in the direction opposite the instantaneous direction of motion of the carriage 15 until the lower surface of the rear push rod 25 no longer rests against the top of the rear slide 22. The rear push rod 25 is immediately pushed downwards in the direction towards the pin 24' by the compression spring 17 acting through the angle member 52, which thereby relaxes the spring 17 to some extent. As a result of the downward movement of the rear push rod 25, the front push rod 25 is brought by the rocker 20 into its upper position.

By such swinging of the rocker 20 in the clockwise direction (as seen from the left), the pin holder 3 is moved upward, and the tips of its pins press the button 37 in the guide jaws 38 upward to such an extent that the top thereof comes to rest against the bottom of the driver disk 34. The driver disk 34 then turns the button 37 around its axis of symmetry until the holes in the button are received on the pins of the pin holder 3. The button 37 then drops a small amount until it rests fully on the pin holder 3, as a result of which its top side no longer rests against the bottom of the driver disk 34.

The other cylinder chamber of the cylinder 18 is then actuated, as a result of which the carriage 15 is now pushed from the rear to the front against the action of the compression spring 16 and in this way the button 37 on the pin holder 3 is brought into the raised button clamp 35. Shortly before the front end position of the carriage 15 is reached, the pin 24 comes against the stop 30, as a result of which the rocker 20 is now swung in counterclockwise direction by the downward movement of the left-hand push rod 25. At this point the pin holder 3 is lowered so that its pins leave the holes in the button 37.

In this way, the pin holder 3 follows a rectangular path (see the chain line adjacent pin holder 3 in FIG. 3). At this point, the button 37, which has been aligned in proper position for sewing, is dependably transferred to the button clamp 35 which—while the pin holder 3 travels in the lower part of its linear quadrangular path into the rear position—moves downward and in this way places the button 37 on the sewing material which has been made ready. Thereupon, the sewing of the button 37 is commenced by the button attaching machine. At the same time the next button 37 passes into the guide jaws 38 and is aligned in the manner described above, and then transferred into the button clamp 35 which has been raised again after the button attaching processes.

Although an illustrative embodiment of the invention has been described in detail herein, it is understood that the invention is not limited to such embodiment, but rather that modifications and variations on the invention may occur to one of ordinary skill in the art within the scope of the invention, as defined only by the claims.

What is claimed is:

1. A button feeding device for aligning a button and placing it in sewing position, comprising:

receiving means for receiving a button from a magazine and locating it in an alignment station;

driver disk means at said alignment station for rotating such button to align it so that holes in the button are in a desired position;

button clamp means at a sewing station for receiving such button after alignment and placing the button at a sewing position;

pin holder means for holding such button in operative engagement with said driver disk means for being aligned thereby and transferring the button to said button clamp means after alignment;

alignment shaft means on which said driver disk means is mounted for rotation, said alignment shaft means having a first longitudinal axis; and drive means having a second longitudinal axis for rotating said alignment shaft means;

said alignment shaft means being displaceable such that said second longitudinal axis is displaceable with respect to said first longitudinal axis, while still being rotatable by said drive means.

2. A device as in claim 1, further comprising carriage means on which said pin holder means is mounted for being moved substantially horizontally between said alignment station and said sewing station;

said pin holder means further being moved substantially vertically upward at said alignment station to bring the button into operative engagement with said driver disk means; and being moved substantially vertically downward at said sewing station for transferring the button to said button clamp means; said pin holder means thereby being moved by said carriage means in a substantially linear quadrangular path.

3. A device as in claim 2, wherein said driver disk means comprises a driver disk including resilient material against which the button is held by said pin holder means, said driver disk rotating the button until holes in the button register with pins on said pin holder means, said button thereby being aligned.

4. A device as in claim 2, wherein said button clamp means is moveable substantially vertically for placing the button at such sewing position.

5. A device as in claim 2, wherein said carriage means comprises a carriage which reciprocates substantially horizontally on a slide rod for imparting such substantially horizontal motion to said pin holder means; and said pin holder means is pivotably mounted on said carriage for being moved substantially vertically.

6. A device as in claim 5, wherein said carriage reciprocates forward and rearward against forces exerted by a pair of front and rear compression springs on said slide rod.

7. A device as in claim 6, wherein said carriage is reciprocated horizontally on said slide rod by a double-action hydraulic cylinder, the carriage also having a rocker pivotably mounted thereon for supporting and imparting vertical motion to the pin holder.

8. A device as in claim 7, wherein said carriage reciprocates in a frame having front and rear vertical end members, said slide rod being mounted between said end members, and said end members thereby limiting the forward and rearward motion of said carriage on said slide rod;

said carriage including front and rear horizontal contact pins which project from the interior to the exterior of said carriage for alternately contacting said end members of said frame as said carriage is reciprocated, said front and rear contact pins being connected to respective horizontal front and rear slides within the carriage having a horizontal compression spring therebetween, each said slide being moved away from the frame and toward the interior of said carriage, against the force of said compression spring, by contact of the respective contact pin with the frame.

9. A device as in claim 8, wherein said carriage further comprises front and rear vertical push rods which are mounted in front and rear portions of said carriage, respectively, for being movable downward when the respective slide is moved toward the interior of the carriage, said push rods further being linked to respective front and rear arms of said rocker for permitting said arms of said rocker to alternately pivot downward.

10. A device as in claim 9, wherein said rocker has a bracket which engages said front and rear compression springs on said slide rod for receiving forces exerted by said spring for pivoting said rocker.

11. A device as in claim 1, wherein said drive means and said alignment shaft means are linked in driving relationship by a coil spring.

12. A device as in claim 11, wherein said drive means includes a motor and a stub shaft connected thereto, and said alignment shaft means includes a pin rotatably linked to said stub shaft by said coil spring, said driver disk means being rotatably connected to said pin.

13. A device in claim 12, wherein respective ends of said spring are received in slots in said stub shaft and said pin.

* * * * *